United States Patent [19]

Braun et al.

[11] Patent Number: 4,742,503

[45] Date of Patent: May 3, 1988

[54] WATCH ASSEMBLY HAVING INTERCHANGEABLE BEZELS AND COORDINATED INTERCHANGEABLE BANDS

[75] Inventors: Refael Braun, Woodmere; Bernard Fernandez, Douglaston, both of N.Y.; Li T. Wing, Tsuen Wan, Hong Kong

[73] Assignee: E. Gluck Corporation, Long Island City, N.Y.

[21] Appl. No.: 55,187

[22] Filed: May 28, 1987

[51] Int. Cl.[4] ..... G04B 37/00

[52] U.S. Cl. ..... 368/282; 368/295

[58] Field of Search ..... 368/281, 282, 283, 284, 368/285, 294–296

[56] References Cited

U.S. PATENT DOCUMENTS

| | | | |
|---|---|---|---|
| 246,104 | 10/1877 | Vong | 325/352 |
| 1,260,278 | 3/1918 | Smith . | |
| 1,264,650 | 4/1918 | Horcasitas et al. . | |
| 1,289,155 | 12/1918 | Goal . | |
| 2,647,668 | 8/1953 | Nyhagen | 224/4 |
| 3,194,004 | 7/1965 | Church | 368/281 |
| 3,492,809 | 2/1970 | Gisiger-Lusa | 368/282 |
| 3,521,798 | 7/1970 | Hill | 224/4 |
| 4,462,697 | 7/1984 | Thompson | 368/282 |
| 4,525,077 | 6/1985 | Ketner | 368/77 |
| 4,592,660 | 6/1986 | Hartman et al. | 368/286 |
| 4,639,144 | 1/1987 | Chau | 368/276 |

FOREIGN PATENT DOCUMENTS

| | | | |
|---|---|---|---|
| 1787013 | 10/1974 | Fed. Rep. of Germany | 368/282 |
| 2231042 | 12/1974 | France | 368/285 |
| 316205 | 11/1956 | Switzerland | 368/296 |

OTHER PUBLICATIONS

Switzerland 48119 Amez-Droz drawing only 7/09.
Switzerland 47976 drawing only 8/09.

*Primary Examiner*—Bernard Roskoski
*Attorney, Agent, or Firm*—Gottlieb, Rackman & Reisman

[57] ABSTRACT

A watch assembly consisting of a case, a removable bezel element and a replaceable band element is provided. The case of the assembly is provided with a pair of brackets depending from its rear face for receiving the band element in the composite assembly. The bezel element is constructed with a pair of retaining platforms for supporting the case when it is placed within the bezel. In assembly, the case and bezel are coupled together, with the platforms holding the case in one direction, and then the band is inserted through the depending brackets of the case, lapping against the bezel and the rear face of the case, thereby preventing movement of the case in an opposite direction.

7 Claims, 2 Drawing Sheets

FIG. 3
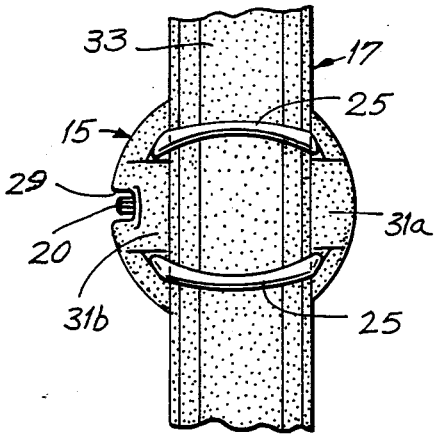
FIG. 4
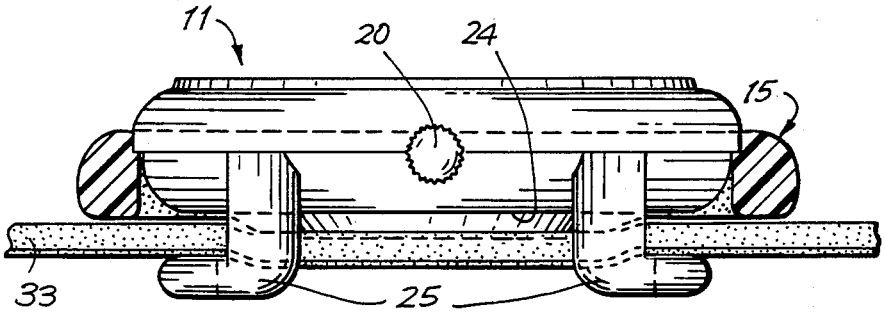
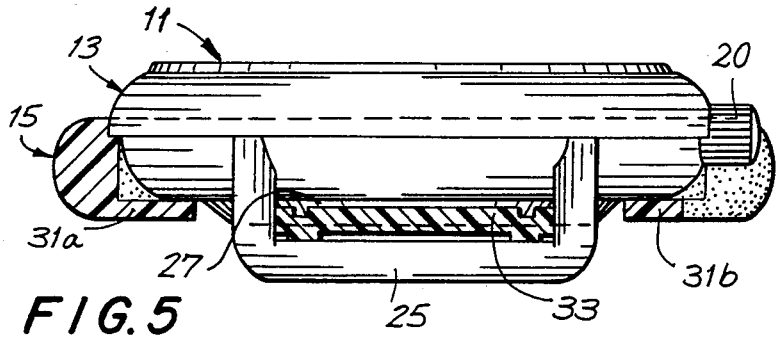
FIG. 5

WATCH ASSEMBLY HAVING INTERCHANGEABLE BEZELS AND COORDINATED INTERCHANGEABLE BANDS

BACKGROUND OF THE INVENTION

This invention relates generally to a multipart watch assembly, and, more particularly, to a watch assembly having several interchangeable bezel elements and corresponding interchangeable band elements, with the bezel and band providing both a security and a decorative function.

With the advent of the latest watch fashions and technology, the availability of different materials to be used in watch components has led to a great diversity in the sizes, shapes and colors of watches. Such developments have virtually revolutionized the contemporary watch business and have made watches far more than mere timepieces, which they had been considered for so long.

These developments have been even more accelerated in the recent era of electronic watches, in which watches in all price categories are battery-driven with quartz crystals generating pulses for counting time and integrated circuits controlling the time regulation function. Normally, watch cases are made self-contained and fit within integral housings to form decoratively attractive packaged assemblies. In this context, each visible watch element has come to be regarded as a candidate for contributing to the overall design impact of the watch, with such creative design treatment primarily focusing on the case, the dial, the bezel and the strap or band.

Even with the recognition that watch cases themselves may be made removable from the remainder of the watch, it has not heretofore been recognized that seemingly less significant watch parts can also be made interchangeable and thereby also enhance the fashionable qualities and utility of a watch. And while watch bands have also been viewed as decorative accessories and have been made interchangeable in a manner to avoid the more cumbersome spring mounted watch bands of the past, they have not generally been thought of as part of the watch assembly in a manner which could contribute to the structural integrity of the watch. Lately, even the watch bezel, traditionally regarded as providing a relatively straightforward retaining function, has started to be considered as having decorative capabilities as well.

Thus, it has become fashionable to wear watches which have bezel, case and band elements which have decorative features, such as attractive colors, and to even provide such watches where the colors of these elements match or blend with each other. This enables the wearer to have a watch which can be color coordinated with his or her shoes, belt or other article of clothing.

However, since most watches are purchased in a fully assembled condition, it is necessary to have a differently colored watch for each occasion on which the wearer wishes to match the color of his or her outfit. Even though the cost of attractive watches has dropped dramatically over the past few years, the requirement to maintain a collection of several watches can become very expensive for the fashion-conscious consumer.

One approach to resolving this problem is to construct a watch having a case element, which includes the watch movement and face, and a separate replaceable one-piece bezel and band element. This type of watch assembly has the advantage that the bezel-band element (typically of molded construction) is changed in order to color coordinate the watch to the wearer's outfit.

Despite recognizing this advantage, the contemporary watch industry has not found such a watch assembly to be completely satisfactory. Since the case is a separate element, common to each combination of associated elements, it must somehow be attached or connected to or held by the bezel-band element before the watch can be worn each time. This has frequently been done by force-fitting the case into the bezel component, so that it may be "popped" into or out of the bezel, or by forming the bezel with a groove so that the case can be snapped or fastened into the bezel. Consequently, attachment of the case to the bezel-band element will not be thoroughly secure, and the case may accidentally "pop out" from the bezel if the wearer of the watch inadvertently bangs or jars the watch.

Accordingly, it is considered desirable to provide an improved watch assembly which has interchangeable bezel and band components that fulfill the appropriate decorative functions and yet overcome the foregoing mechanical security problems.

It is therefore an object of the invention described herein to provide a watch assembly having a separate interchangeable bezel element and a separate mutually dependent interchangeable band element.

It is also an object of this invention to form a bezel for a watch which can be interchanged periodically at the discretion of the wearer, concurrently with or without changing the band of the watch, to provide a decorative and secure watch assembly.

It is a still further object of the invention to provide a watch assembly which can be color coordinated to the clothing outfit of the wearer.

It is another object of this invention that a watch assembly be capable of being created from a variety of different materials for respective interchangeable elements thereof.

It is also an object of this invention that the ease of interchanging watch assembly components minimizes a user's concern for highly precise dimensional fitting between such components.

A further object of this invention is to enable a user of a multi-part watch assembly to create a different appearance for the watch by virtue of selectively changing the shape or the material of the parts, thereby effecting cost savings and decorative advantages.

Yet another object of the invention described herein is to provide a watch assembly which utilizes the structural configuration of the bezel in cooperation with the band element to maintain secure engagement of the bezel, band and the watch case.

Still other objects and advantages of the invention will be apparent from the following specification when considered in conjunction with a specific embodiment of the invention as hereinafter described.

SUMMARY OF THE INVENTION

Generally speaking, in accordance with the invention, a watch assembly consisting of a case, an interchangeable bezel and an interchangeable band is shown and described. The case of the watch assembly is provided with a pair of elevated brackets extending from its rear face for receiving therethrough the band element.

The bezel, adapted to accommodate the case member, includes a pair of retaining lugs so that when the case is received in the central cavity of the bezel, the case is prevented from moving in a downward direction, away from the rear face of the case. After the bezel and case are joined together in this manner, the band is inserted through the brackets of the case, and presses snugly against the lower rim of the bezel and the bottom face of the case. This has the effect of inhibiting movement of the bezel in an upward direction, away from the front face of the watch, thereby ensuring selectively releasable and yet tight engagement of the bezel about the rim of the case.

The corresponding bezel and band components of the watch assembly of this invention are preferably formed of a plastic material and have a fashionable color. It should be appreciated that this invention contemplates a wide range of color coordination among the various watch components, including the use of both similar and also suitably contrasting colors, all within the framework of achieving an attractive and colorful watch assembly. This enables easy replacement of one set of matching bezel and band components with other pairs of bezel and band components for color coordinating the watch assembly with the wearer's clothing or other fashion accessory.

It is therefore a feature of an embodiment of this invention that a watch case is formed with spaced brackets to receive a watch band therethrough so as to secure the coupling of the case and a surrounding bezel, and to resist movement of the case in an upward direction.

It is also a feature of an embodiment of this invention that a watch bezel is provided with supporting lugs to accommodate the watch case and to act as stops for the case in a downward direction.

It is still another feature of an embodiment of this invention that the watch bezels and bands are color coordinated with each other and are adapted to be replaced in corresponding pairs, so that a single watch case can be utilized with each such pair in securely fixed configuration in which the band and bezel cooperate to hold the case in place.

The invention accordingly comprises the assembly embodying the features of construction, combination of elements and arrangement of parts as exemplified in the following detailed disclosure, as well as the method for constructing the assembly, and the scope of the invention will be indicated in the claims.

DESCRIPTION OF THE DRAWINGS

For a fuller understanding of the invention, reference is made to the following detailed description, taken in connection with the accompanying drawings, in which:

FIG. 3 is a partially fragmentary rear view of the watch assembly shown in FIG. 2;

FIG. 4 is an enlarged partial cross-sectional view of the assembled case, bezel and band elements, taken along the line 4—4 of FIG. 2 in the direction of the arrows; and FIG. 5 is an enlarged partial cross-sectional view taken along the line 5—5 of FIG. 2 in the direction of the arrows.

DESCRIPTION OF THE PREFERRED EMBODIMENT

Figures 1, 2:
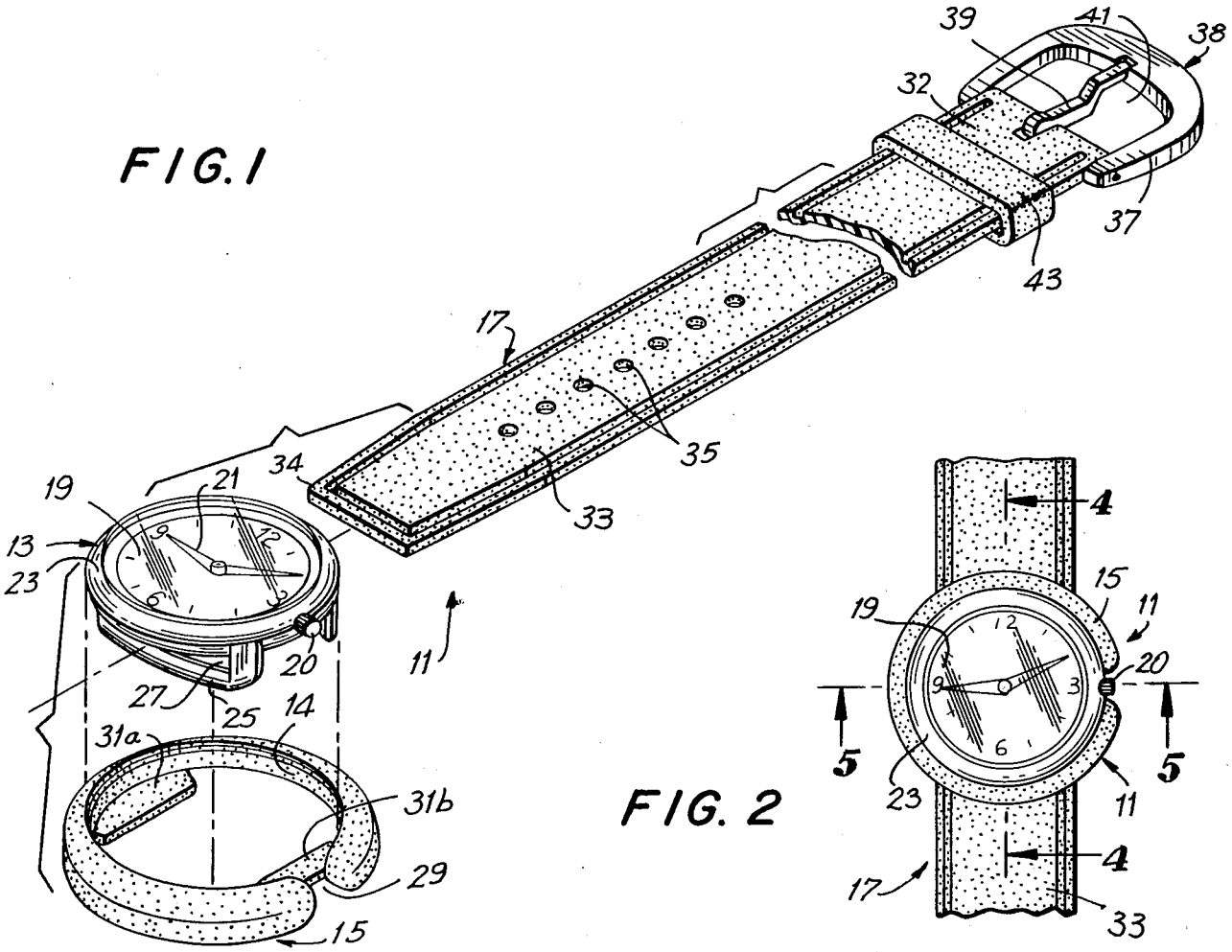
FIG. 1 is an exploded perspective view showing the case, bezel and band elements of a watch assembly in accordance with the invention.
FIG. 2 is a partially fragmentary front view of the watch assembly in accordance with the invention.

Referring now to the drawings, a watch assembly generally designated at 11 in accordance with the invention is disclosed. As illustrated in FIGS. 1 and 2, watch assembly 11 includes a substantially disk-shaped case 13, a correspondingly shaped annular bezel 15 and a band 17. While case 13 has been shown in a generally circular configuration, this invention can also be utilized with numerous other shapes for case 13, including triangles, squares and polygons, with the interior cavity 14 of bezel 15 being correspondingly configured to accept such other shaped case. Case 13 includes a rear face 24 and a substantially outer annular outer rim 23 which houses a watchface 19 for displaying time indicating elements 21. Extending outwardly from rim 23 is a knob 20 which is capable of being partially withdrawn and turned and adjusted in order to adjust time indicating elements 21 for display of the correct time. Extending rearwardly from rear face 24 of case 13 are a pair of brackets 25, which define slots 27 of case 13 suitable for receiving band 17 of the assembly.

Referring now to FIG. 3, as well as to FIGS. 1 and 2, bezel 15 of watch assembly 11 is shown formed with a recess 29, which receives knob 20 of case 13 during assembly. Because of the accommodating shape of recess 29 relative to the placement therein of knob 20, and the incompatibility of knob 20 with regard to any other portion of bezel 15, the assembly to be described hereinafter can be seen to be "user friendly", that is, promoting the quick and easy interconnection of case 13 and bezel 15. Bezel 15 includes first and second retaining platforms **31*a* and 31*b* positioned along the rear portion thereof. During assembly, platforms 31*a* and 31*b* support case 13, as described hereinafter, thereby preventing any movement case 13 downward, and also restricting movement of bezel 15 in an upward direction, i.e., away from rear face 24 of case 13**.

Band 17, as illustrated in FIG. 1, and which may conveniently be made of suitable flexible plastic, consists of an elongated strap 33 formed with a plurality of axially oriented holes 35 extending therethrough, a first end 32 of the strap 33 being provided with an adjustable loop 43, and a second free end 34 disposed opposite from end 32. (Band 17 can also be formed with other less rigid materials, including fabric, such as in the form of a scarf, or also of more traditional leather.). Strap 33 is terminated at end 32 with a buckle assembly 38, defined by a buckle element 37 and a tongue 39. In order to ultimately wear watch assembly 11 (following attachment of band 17, case 13 and bezel 15 as described below), band 17 is wrapped around the wrist of the user and free end 34 of strap 33 is inserted through buckle element 37 and then suitably tightened. Thereafter, tongue 39 of assembly 38 is inserted through the appropriate one of holes 35 formed in strap 33, depending on the desired tightness of band 17. The excess portion of strap 33 (beyond the selected one of holes 35) is held in place by inserting free end 34 through loop 43.

Turning now to FIGS. 2–5, assembly of watch assembly 11 in accordance with the invention is now described. Bezel 15 is first positioned beneath case 13 (see also FIG. 1) and then case 13 is seated within bezel 15 by positioning bezel 15 over and around rim 23. During assembly, bezel 15 must be aligned with case 13 so that knob 20 is received in recess 29 of bezel 15. Once case 13 is seated within bezel 15, a mutually restrictive composite structure is established —bezel 15 is prevented from moving in an upward direction (i.e., in a direction away from rear face 24) due to platforms 31*a* and 31*b*, which abut rear face 24 of case 13, as best shown in FIG. 5. At the same time, the same platform members act as stops with respect to any possible downward movement of case 13 through to main central opening of bezel 15.

After bezel 15 is joined with case 13, as described herein, brackets 25 of case 13 depend sufficiently below the rear surface of case 13 (see FIGS. 4 and 5) so as to expose slots 27 for entry of strap 17. In this position, free end 34 of strap 33 is inserted through both accessible slots 27 of brackets 25, thereby connecting band 17 to the assembly, as best illustrated in FIGS. 3 and 4, and case 13 is now securely held against upward releasing movement away from its seated position within bezel 15, while bezel 15 is also prevented from moving in a downward direction (i.e., in a direction away from watchface 19), since strap 33 presses against bezel 15. Therefore, bezel 15, coupled about rim 23 of case 13, remains permanently engaged in the assembly with case 13.

In order to replace bezel 15 and band 17 with a second pair of bezel and band components, for example to effect suitable color coordination, watch assembly 11 is initially disassembled by first removing strap 33 of band 17 from slots 27 of brackets 25, thereby disconnecting band 17 from case 13 of the assembly. Then, case 13, seated within bezel 15, is disengaged therefrom by elevating case 13 upwardly to the position showin in FIG. 1 so that platforms 31*a* and 31*b* of bezel 15 no longer support case 13.

Once watch assembly 11 is disassembled in this manner, a second bezel and band pair may be combined with case 13 in order to form a second watch assembly in accordance with the invention. Assembly using such a second bezel and band pair follows the same steps as assembly using original bezel 15 and band 17, described hereinabove.

Since the watch assembly of the invention can be seen to include an interchangeable bezel component and a similarly interchangeable band component, it is possible to have bezel and band pairs of different colors. This enables the color coordination of the watch assembly with the clothing, accessories or even the complexion of the wearer, while still enabling utilization of the same case element (which is the most expensive watch component since it includes the time keeping hardware such as the movement, quartz crystal and battery). Thus, the wearer will always be fashionably outfitted by choosing bezel and band elements of the appropriate color, from a grouping that may be supplied when the watch is purchased, or perhaps sold separately, but in either event will avoid the additional cost of buying a number of separate watches.

Furthermore, because the assembly comprises an integrated system of band, bezel and case, facilitating secure engagement of the three major components of the watch, it is no longer necessary that the case of the watch include specially designed grooves, snaps or other fittings for receiving the bezel thereabout for attachment purposes. This is especially advantageous in the watch manufacturing and assembly field where such extra fittings frequently prove to be harder to mold or machine, are usually more expensive and significantly increase the failure rate in manufacture.

It will thus be seen that the objects set forth above, among those made apparent from the preceding description, are efficiently attained, and, since certain changes may be made in the above construction, dimensions or approach, as well as in the above method, without departing from the spirit and scope of the invention, it is intended that all matter contained in the above description, or shown in the accompanying drawings, shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A watch assembly comprising:

a case having a front face for displaying the time, a rear face and a rim defining the circumference of said case;

a removable band positioned in overlapping relation to the rear face of said case;

a removable bezel releasably secured around said rim of said case, wherein said bezel includes means for inhibiting movement of said case relative to said bezel in a direction substantially normal to said case and towards said band; and means for coupling said band to said case so that said band inhibits movement of said case in a direction normal to said case and away fromn said band, said coupling means projecting from the rear face of said case and spaced therefrom to accommodate said band therethrough.

2. The watch assembly of claim 1, wherein said inhibiting means comprises at least one platform extending inwardly from said bezel element to receive said rear face of said case thereon.

3. The watch assembly of claim 1, wherein said coupling means comprises at least one bracket element extending from said rear face of said case and defining a slot between said bracket and said rear face for receiving said band therethrough.

4. The watch assembly of claim 3, including a pair of said brackets at opposed ends of said rear face.

5. The watch assembly of claim 3, wherein said case includes a time adjusting knob extending therefrom.

6. The watch assembly of claim 5, wherein said bezel is formed with a recess for receiving said knob.

7. A watch assembly comprising:

a case having a front face for displaying the time, a rear face and a rim defining the circumfernece of said case;

a removable bezel adapted to be releasably secured around the rim of the case;

a removable band positioned in overlapping relation to said rear face of said case;

at least one platform extending inwardly from said bezel element to receive said rear face of said case thereon, said at least one platform preventing movement of said case in a direction substantially normal to said case and towards said band; and at least one bracket element extending from the rear face of said case and defining a slot between said bracket and said rear face for coupling said band to said case, said band inhibiting movement of said case in a direction substantially normal to said case and away from said band.

* * * * *